US006204608B1

(12) United States Patent
Song et al.

(10) Patent No.: US 6,204,608 B1
(45) Date of Patent: Mar. 20, 2001

(54) FIELD EMISSION DISPLAY DEVICE

(75) Inventors: Yoon Ho Song; Jin Ho Lee, both of Daejon; Seung Youl Kang, Seoul; Sung Yool Choi; Kyoung Ik Cho, both of Daejon, all of (KR)

(73) Assignee: Electronics and Telecommunications Research Institute, Daejon (KR)

( * ) Notice: Subject to any disclaimer, the term of this patent is extended or adjusted under 35 U.S.C. 154(b) by 0 days.

(21) Appl. No.: 09/442,486

(22) Filed: Nov. 18, 1999

(30) Foreign Application Priority Data

Nov. 30, 1998 (KR) ..... 98-52018

(51) Int. Cl.[7] ..... G09G 3/30; G09G 5/00

(52) U.S. Cl. ..... 315/169.3; 315/169.4; 345/76

(58) Field of Search ..... 315/169.1, 169.2, 315/169.3, 169.4, 167; 345/55, 60, 63, 75, 76, 77

(56) References Cited

U.S. PATENT DOCUMENTS

| | | | | |
|---|---|---|---|---|
| 5,210,472 | | 5/1993 | Casper et al. | 315/349 |
| 5,347,292 | * | 9/1994 | Ge et al. | 315/169.1 |
| 5,402,041 | * | 3/1995 | Kishino et al. | 315/169.1 |
| 5,739,642 | * | 4/1998 | Peng et al. | 315/169.3 |
| 5,783,910 | * | 7/1998 | Casper et al. | 315/169.3 |
| 5,786,796 | * | 7/1998 | Takayama et al. | 315/169.3 |

FOREIGN PATENT DOCUMENTS

| | | |
|---|---|---|
| 7-254383 | 10/1995 | (JP) . |
| 8-140009 | 5/1996 | (JP) . |

OTHER PUBLICATIONS

Seigo Kanemaru et al., "MOSFET–structured Si field emitter tip", Technical Digest of IVMC 97, Kyongju, Korea 1997, pp. 34–37.

Gen Hashiguchi et al., "A Novel Multi–Layered Device of Polycrystalline Silicon Field Emitters and Thin Film Transistor for Field Emission Dispalys", IDW 96, pp. 159–162.

R. Baptist et al., "Microtips and Resistive Sheet: A Theoretical Description of the Emissive Properties of This System", 9$^{th}$ International Vacuum Microelectronics Conference, St. Petersburg 1996, pp. 19–23.

* cited by examiner

*Primary Examiner*—Don Wong
*Assistant Examiner*—Wilson Lee
(74) *Attorney, Agent, or Firm*—Jacobson, Price, Holman & Stern, PLLC

(57) ABSTRACT

A field emission display device is disclosed. The device comprises an upper plate and a lower plate that are vacuum-packaged in parallel, wherein the lower plate is composed of matrix-addressable pixels, wherein the pixel formed on an insulation substrate comprises a field emitter array, a control thin-film transistor having a drain connected to an emitter electrode of the emitter array, and an addressing thin-film transistor having a drain connected to a gate electrode of the control thin-film transistor. Designing the control thin-film transistor to have a large parasitic capacitance between the source and the gate, one can obtain an active matrix display having a memory function and eliminate a conventional complex fabricating process of a memory capacitor, thereby simplify a panel fabricating process remarkably and largely increase the aperture ratio of a pixel. Furthermore, in the present invention, introducing glass for a substrate material instead of conventional single crystal silicon wafer, one can cheaply produce a large size panel and easily carry out a vacuum packaging that is indispensable for fabricating a field emission display.

10 Claims, 3 Drawing Sheets

FIELD EMISSION DISPLAY DEVICE

BACKGROUND OF THE INVENTION

1. Field of the Invention

The present invention relates to a field emission display device, and more particularly relates to a field emission display device that is able to achieve a high-luminance display panel with high aperture ratio and large-size fabricating capability.

2. Information Disclosure Statement

A field emission display device generally represents a device in which a field emission device is applied to a flat panel display device. This kind of field emission display device is produced by vacuum packaging a lower plate having a field emitter array and an upper plate having a phosphor, in parallel with narrow gap (within 2 mm), and it displays an image by the cathode luminescence of the phosphor caused by bombarding electrons that are emitted from the field emitters of the lower plate into the phosphor of the upper plate. Recently, it is widely researched and developed as a substitutional flat panel display for the conventional cathode ray tube (CRT).

A field emission display device is classified into a simple matrix type panel and an active matrix type panel according to the structure of the pixels arranged in matrix on the lower plate. In case of a simple matrix type panel each pixel comprises only a field emitter arrays, whereas of an active matrix type panel each pixel comprises a field emitter arrays and semiconductor devices (mainly, transistors) that controls field emission currents of the field emitter array. A prior active matrix type panel is illustrated in FIG. 1 and FIG. 2.

FIG. 1 is an overall schematic diagram illustrating a lower plate structure of a prior field emission display device. Each pixel formed on a single crystal silicon wafer 10P comprises a field emitter array 20P comprising a plurality of triode-type field emitters, a control transistor 30P having a drain connected to the emitter electrode of the field emitter array 20P, a memory capacitor 40P having an upper electrode connected to the gate electrode of the control transistor 30P, and an addressing transistor 50P having a drain connected to the upper electrode of the memory capacitor 40P. The addressing transistor 50P writes scan signals and data signals from a signal line of a display into each pixel, the memory capacitor 40P stores the data signals of a display, and the control transistor 30P controls field emission currents of the field emitter array 20P according to the data signals.

A detailed structure of the pixel is illustrated in FIG. 2.

In a prior active matrix field emission display device, a pixel, which compose a lower plate, comprises; a p-type silicon wafer 10P, an addressing transistor 50P comprising a source 501P/drain 502P, made of n-type silicon, formed on said wafer 10P, a gate 504P formed on the upper part of the wafer 10P, a source electrode 505P formed on the upper part of the wafer 10P and electrically connected to the source 501P, and a gate insulation film 503P to electrically insulate the gate 504P from the source 501P/drain 502P and silicon channel 10P, a memory capacitor 40P comprising a lower electrode 401P, formed on the wafer 10P, made of n-type silicon, an upper electrode 403P, formed on the upper part of the wafer 10P, make of metal or n-type silicon, and a gate dielectric film 402P between the lower electrode 401P and the upper electrode 403P, a control transistor 30P comprising a source 301P/drain 302P, formed on the wafer 10P, made of n-type silicon, a gate 304P formed on the upper part of the wafer 10P, a source electrode 305P formed on the upper part of the wafer 10P and electrically connected to the source 301P, and a gate insulation film 303P to electrically insulate the gate 304P from the source 301P/drain 302P and silicon channel 10P, a field emitter array 20P comprising a plurality of field emitter tips 201P formed on the drain 302P of the control transistor 30P and a gate 202P, and a connection electrode 345P connected to drain 502P of the addressing transistor 50P, an upper electrode 403P of the memory capacitor 40P, and a gate electrode 304P of the control transistor 30P.

The display device is operated by applying a prescribed voltage required for a field emission to the gate 202P of the field emitter array 20P, thereafter writing a scan and a data signal of a display to the gate 504P and the source 501P of the addressing transistor 50P. Once the signal is written, it is stored in the memory capacitor 40P and continuously operates the control transistor 30P until the next scan signal arrives (In other words, the control transistor 30P is being operated continuously even in non-scan interval.). Therefore, it is accomplished to largely increase the average emission current of a given field emitter array, thereby largely increase the brightness of a display.

The lower plate of a prior field emission display device, by the benefit of using a single crystal silicon wafer 10P, can produce a high-performance addressing transistor 50P, memory capacitor 40P and control transistor 30P, thereby easily produce a high performance active matrix field emission display device. However, it can not produce a large size display device because of the high price of a single crystal silicon wafer 10P and the limit of the size thereof. And the vacuum packaging is difficult because of the mechanical weakness of a single crystal silicon wafer 10P.

In addition, the lower plate of a prior field emission display device has a good data signal holding performance because it has an independent memory capacitor 40P in each pixel, however, it has the demerits that is needs additional processes for the fabrication of the memory capacitor 40P and an aperture ratio of a pixel is decreased because of the area reduction by the memory capacitor 40P existence.

SUMMARY OF THE INVENTION

It is therefore the object of the present invention to provide a field emission display device, which is able to provide an active matrix display having a memory function and to eliminate a conventional complex fabricating process of a memory capacitor, thereby simplify a panel fabricating process and largely increase the aperture ratio of a pixel, by designing a control thin-film transistor to have a large parasitic capacitance between the source and the gate.

It is another object of the present invention to enable to cheaply produce a large size panel and to easily carry out a vacuum packaging that is indispensable for fabricating a field emission display by introducing glass for a substrate material instead of a conventional single crystal silicon wafer.

To achieve the object, a field emission display device in accordance with the present invention comprises an upper plate and a lower plate that are vacuum-packaged in parallel, wherein the lower plate is composed of matrix-addressable pixels, wherein the pixel formed on an insulation substrate comprises a field emitter array, a control thin-film transistor having a drain connected to the emitter electrode of the field emitter array, and an addressing thin-film transistor having a drain connected to the gate of the control thin-film transistor, wherein the field emitter array comprises a plurality of triode-type field emitters and the control thin-film transistor has a prescribed parasitic capacitance between the source and the gate enough to retain a data signal during a signal frame of the scan signal.

To achieve the object, a field emission display device in accordance with an embodiment of the present invention comprises an upper plate and a lower plate that are vacuum-packaged in parallel, wherein the lower plate comprises an insulation substrate, an emitter electrode formed on the upper part of the insulation substrate, a plurality of emitter tips formed on the emitter electrode, a gate insulation film formed apart with a certain distance from the emitter tips, the first gate formed on the gate insulation film, the second gate formed on the upper part of the insulation substrate, a gate insulation film formed on the upper part of the second gate including a portion of the upper part of the insulation substrate, the first semiconductor channel formed on the gate insulation film, the first source formed to be vertically overlapped with the second gate at an end on the first semiconductor channel, the first drain formed not to be vertically overlapped with the second gate at the opposite end of the first source and electrically connected with the emitter electrode, the first source electrode formed on the upper part of the first source and electrically connected to the first source, the third gate formed on the insulation substrate, a gate insulation film formed on the upper part of the third gate including a portion of the upper part of the insulation substrate, the second semiconductor channel formed on the gate insulation film, the second source and the second drain formed on a certain portion at each end of the second semiconductor channel, the second source electrode formed on the upper part of the second source and electrically connected to the second source, and a connection electrode electrically connecting the second drain with the second gate electrode.

BRIEF DESCRIPTION OF THE DRAWINGS

The above objects and other advantages of the present invention will become more apparent by describing in detail the preferred embodiment of the present invention with reference to the attached drawings in which.

Similar reference characters refer to similar parts in the several views of the drawings.

DETAILED DESCRIPTION OF THE INVENTION

Referring to appended drawings, detailed description of the present invention is now described.

Figure 1:
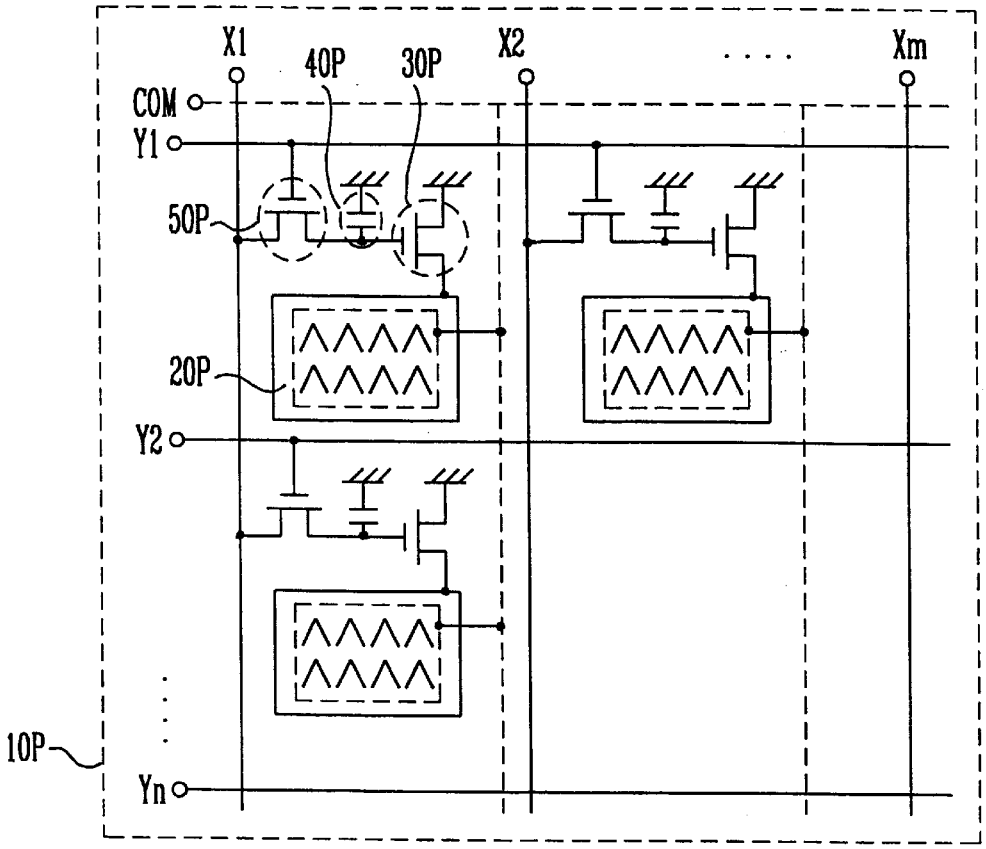
FIG. 1 PRIOR ART
FIG. 1 is an overall schematic diagram illustrating a lower plate structure of a prior field emission display device.
Figure 2:
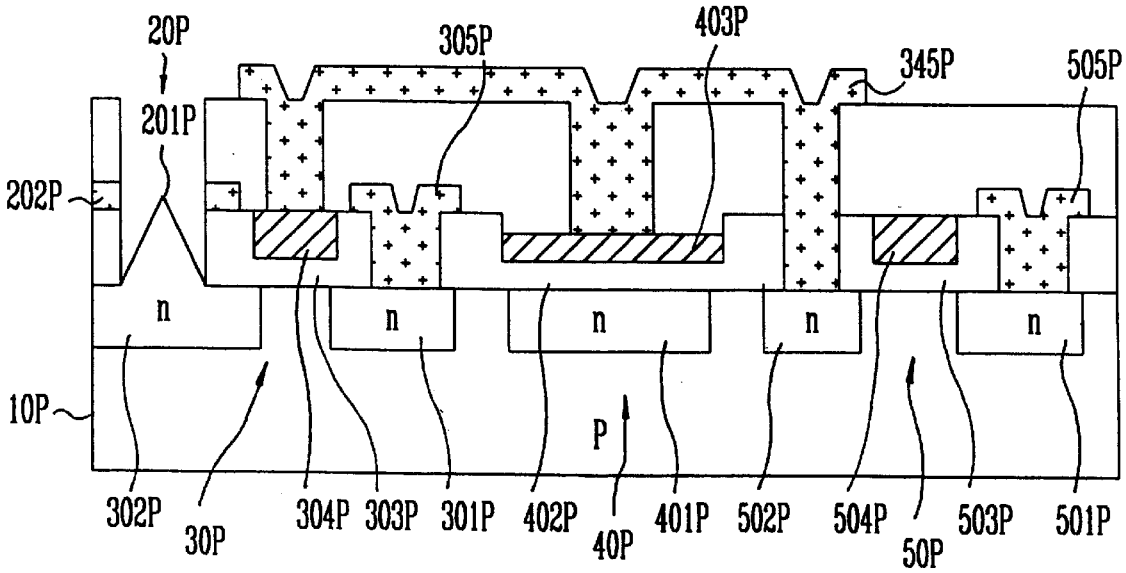
FIG. 2 PRIOR ART
FIG. 2 is a cross sectional view illustrating a pixel structure of a prior field emission display device.
Figure 3:
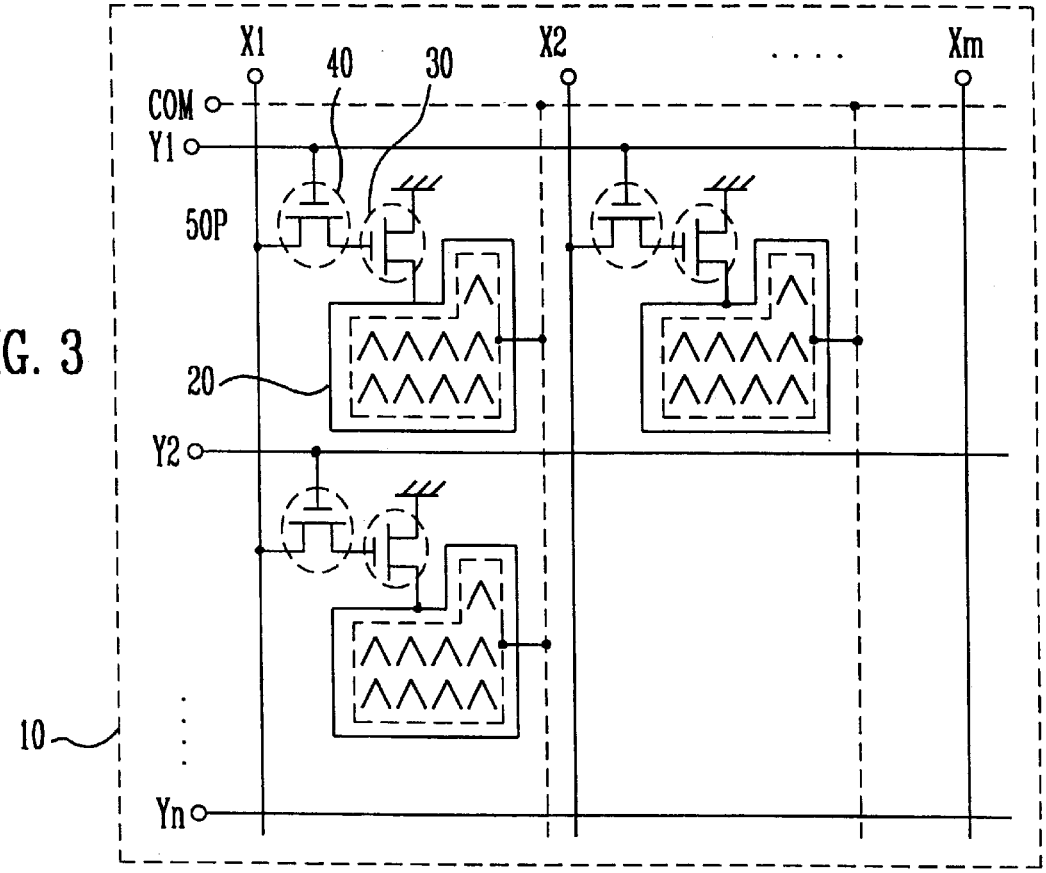
FIG. 3 is an overall schematic diagram illustrating a lower plate structure of a field emission display device in accordance with the present invention.
Figure 4:
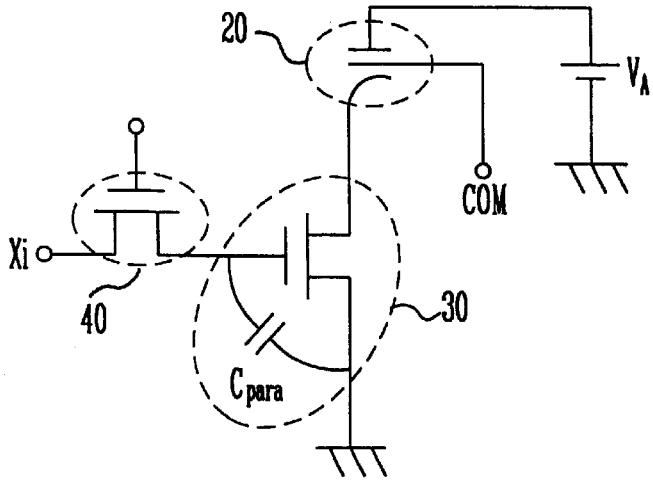
FIG. 4 is an equivalent circuit diagram of a lower plate pixel of a field emission display device in accordance with the present invention.

FIG. 3 is an overall schematic diagram illustrating a lower plate structure of a field emission display device in accordance with the present invention, and FIG. 4 is an equivalent circuit diagram of a lower plate pixel of a field emission display device in accordance with the present invention.

Referring to FIG. 3, the lower plate of the field emission display device in accordance with the present invention is composed of matrix-addressable pixels, in which each pixel, formed on an insulation substrate 10 such as a glass substrate, comprises a field emitter array 20 comprising a plurality of triode-type field emitters, a control thin-film transistor 30 having a drain connected to the emitter electrode of the field emitter array 20, and an addressing thin-film transistor 40 having a drain connected to the gate of the control thin-film transistor 30, wherein the gate and source of the addressing thin-film transistor 40 are connected to a scan signal line and a data signal line respectively, and the gate of the field emitter array 20 is biased to the common voltage in all or some pixels, and the source of the control transistor 30 is grounded in all pixels.

The control thin-film transistor 30 has a large parasitic capacitance between the source and the gate enough to retain a data signal during a single frame of scan signal. And it also has the characteristics of high breakdown voltage and low leakage current so that is can be operated steadily even under high drain voltages. The equivalent circuit diagram of the pixel is described in FIG. 4, and the control thin-film transistor 30 has a large parasitic capacitance $C_{para}$ between the source and the gate.

The active matrix field emission display device in accordance with the present invention can be operated by applying a prescribed DC voltage (generally, higher than 50 V) required for a field emission to the common gate of the field emitter array 20, thereafter writing scan and data signals to the gate and the source of the addressing thin-film transistor 50, respectively. Once a data signal is written into a pixel of the lower plate of the field emission display device, it is stored in parasitic capacitance of the control thin-film transistor 30 and continuously operates the control thin-film transistor 30 until the next signal arrives. The control thin-film transistor 30 directly controls the field emission currents of the field emitter array 20. The gray representation of the display can be accomplished by changing the voltage amplitude of data signals. The operation method of an active matrix field emission display device in accordance with the present invention is similar to that of thin-film transistor-liquid crystal display (TFT-LCD). And, unlike the conventional simple matrix field emission display, it can be operated with a lower voltage and largely increase the brightness of a display.

Figure 5:
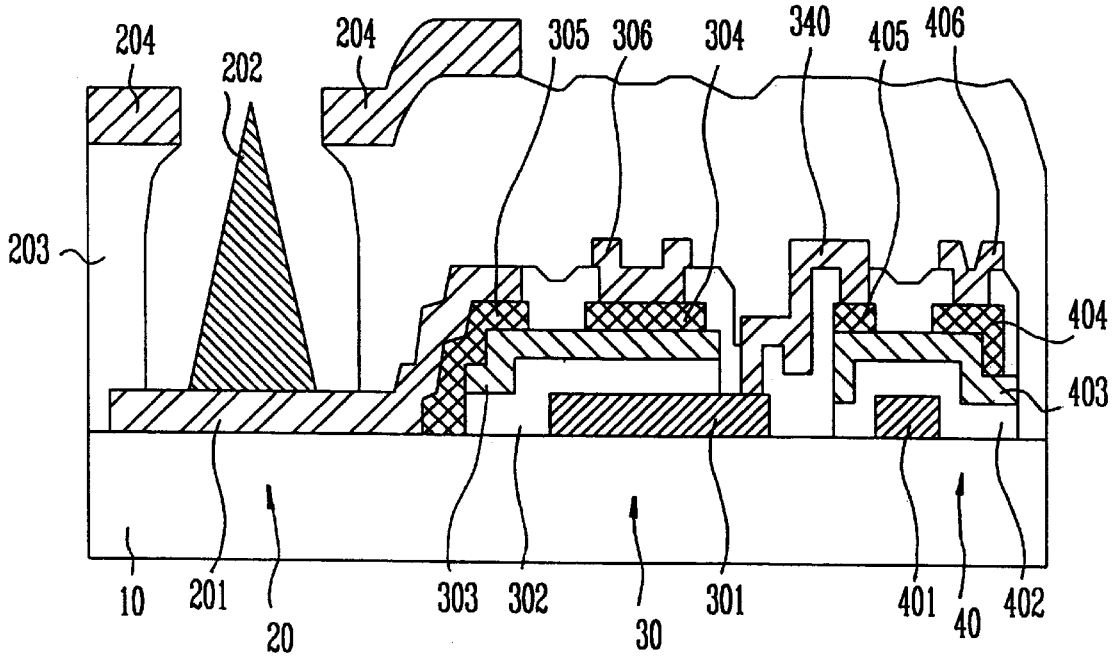
FIG. 5 is a cross sectional view illustrating a pixel structure of a field emission display device in accordance with the present invention.
Figure 6:
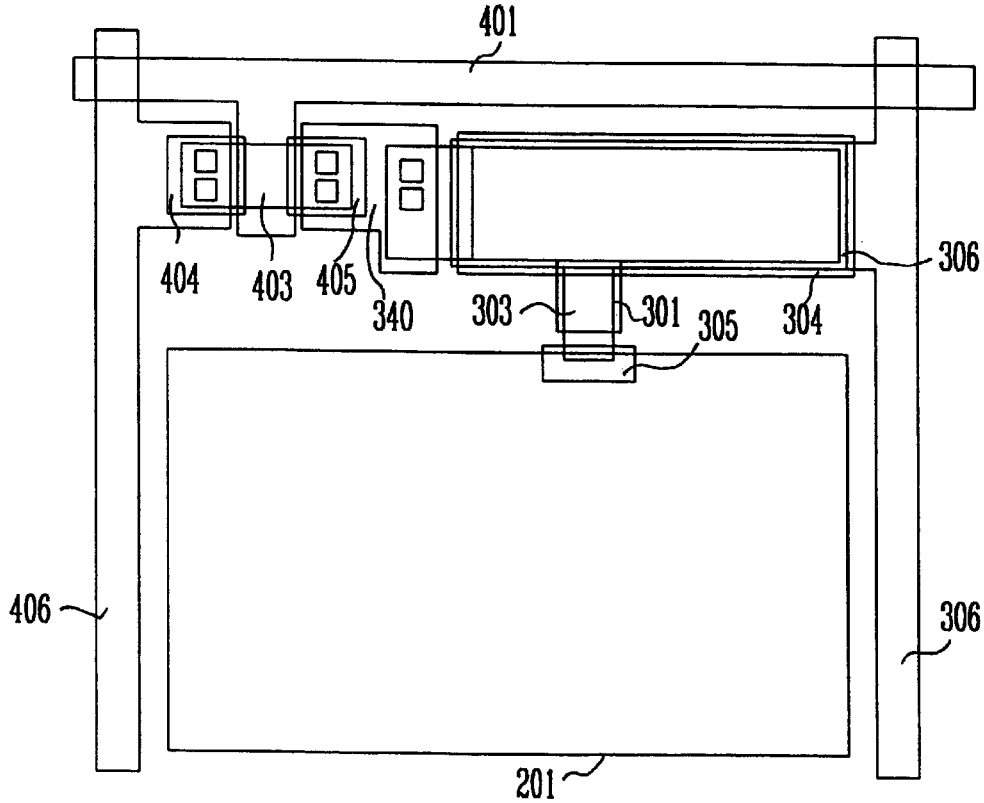
FIG. 6 is a plane view illustrating a pixel structure of a field emission display device in accordance with the present invention.

For a reference, an embodiment of a field emission display device in accordance with the present invention is now described referring to FIG. 5 and FIG. 6.

FIG. 5 and FIG. 6 illustrate a cross sectional view and a plane view of a pixel structure of the lower plate of a field emission display device in accordance with the present invention, respectively. The control thin-film transistor and the addressing thin-film transistor in the figures comprise inverted stagger type amorphous silicon thin-film transistors.

A pixel on the lower plate of the field emission display device in accordance with the present invention comprises; an insulation substrate 10 such as a glass substrate, a field emitter array 20 comprising a metallic emitter electrode 201 formed on a selected area of the upper part of the insulation substrate 10, a plurality of metallic or silicon emitter tips 202 formed on the emitter electrode 201, a gate insulation film 203 formed on the apart with a certain distance from the emitter tips 202, and a metallic gate 204 formed on the gate insulation film 203.

A control thin-film transistor 30 comprising a metallic gate 301 formed on a selected area of the upper part of the insulation substrate 10, a gate insulation film 302, made of insulation material like silicon nitride ($SiN_x$), formed on the upper part of the gate 301 and on a selected portion of the upper part of the insulation substrate 10, a semiconductor channel 303, made of hydrogenated amorphous silicon (α-Si:H), formed on the gate insulation film 302, a source 304, made of n-type amorphous silicon, formed to be vertically overlapped with the gate 301 at an end on the channel 303, a drain 305, made of n-type amorphous silicon, formed not to be vertically overlapped with the gate 301 at the opposite end of the source 304, and a metallic source electrode 306 formed on the upper part of the source 304 and electrically connected to the source 304, and an addressing thin-film transistor 40 comprising a metallic gate 401 formed on a selected area of the upper part of the insulation substrate 10, a gate insulation film 402, made of insulation material like silicon nitride ($SiN_x$), formed on the upper part of the gate 401 and on a selected portion of the upper part of the insulation substrate 10, a semiconductor channel 403, made of hydrogenated amorphous silicon (α-Si:H), formed on the gate insulation film 402, a source 404 and a drain 405, made of n-type amorphous silicon, formed on a certain portion at each end of the channel 403, and a metallic source electrode 406 formed on the upper part of the source 404 and electrically connected to the source 404.

In the embodiment described above, a certain portion of the emitter electrode 201 of the field emitter array 20 covers the drain 305 of the control thin-film transistor 30, thereby electrically connected to the drain 305, and the drain 405 of the addressing thin-film transistor 40 is electrically connected to the gate 301 of the control thin-film transistor 30 by the metallic connection electrode 340. And the source 304 of the control thin-film transistor 30 is designed to be vertically overlapped over a wide region with the gate 301 to produce a large parasitic capacitance, whereas the drain 305 is designed not to be vertically overlapped with the gate 301 to achieve a high breakdown voltage.

FIG. 6 is a plane layout of a pixel illustrated in FIG. 5. Referring to FIG. 6, the gate 401 and the source electrode 406 of the addressing thin-film transistor 40 are connected to the scan and the data signal lines of the display, respectively, and the source electrode 306 of the control thin-film transistor 30 is appeared to be grounded in the whole pixel.

The embodiment of the present invention described in FIG. 5 and FIG. 6 can be produced on the same glass substrate by using a conventional process technique of an amorphous silicon thin-film transistor (α-Si:H TFT) and a Spindt tip technique such as a molybdenum (Mo) field emitter, or a silicon field emitter technique.

Since those having ordinary knowledge and skill in the art of the present invention will recognize additional modifications and applications within the scope thereof, the present invention is not limited to the embodiments and drawings described above.

As described above, a pixel of the lower plate of the field emission display device in accordance with the present invention comprise a field emitter array, a control thin-film transistor, and an addressing thin-film transistor formed on the upper part of an insulation substrate such as a glass substrate, wherein the control thin-film transistor is designed to have a large parasitic capacitance between the source and the gate and also to have the characteristics of high breakdown voltage and low leakage current, thereby one can obtain an active matrix display device having a memory function and simplify a panel fabricating process remarkably and largely increase the aperture ratio of a pixel by eliminating a memory capacitor from a prior active matrix type pixel. As a result, one can fairly increase the brightness of a display and easily manufacture a high-resolution panel.

Furthermore, in the present invention, by introducing glass for a substrate material instead of conventional single crystal silicon wafer, a large size panel can be cheaply produced and a vacuum packaging, that is indispensable for fabricating a field emission display, can be easily carried out.

What is claimed is:

1. A field emission display device comprises an upper plate and a lower plate that are vacuum-packages in parallel, wherein said lower plate is composed of matrix-addressable pixels on an insulation substrate, wherein said pixel comprises a field emitter array, a control thin-film transistor having a drain connected to an emitter electrode of said field emitter array and a parasitic capacitance between a source and a gate, and an addressing thin-film transistor having a drain connected to said gate of said control thin-film transistor.

2. The field emission display device as claimed in claim 1, wherein said field emitter array comprises a plurality of triode-type field emitters.

3. The field emission display device as claimed in claim 1, wherein said parasitic capacitance has a capacitance enough to retain a data signal during a signal frame of scan signal.

4. A field emission display device comprises an upper plate and a lower plate that are vacuum-packaged in parallel, wherein said lower plate comprises:

an insulation substrate;

a field emitter array comprising an emitter electrode formed on the upper part of a said insulation substrate, a plurality of emitter tips formed on said emitter electrode, a gate insulation film formed apart with a certain distance from said emitter tips, and a first gate formed on said gate insulation film;

a control thin-film transistor comprising a second gate formed on the upper part of said insulation substrate, a gate insulation film formed on the upper part of the second gate including a portion of the upper part of said insulation substrate, a first semiconductor channel formed on said gate insulation film, a first source formed to be vertically overlapped with said second gate at an end on said first semiconductor channel, a first drain formed not be vertically overlapped with said second gate at the opposite end of said first source, and a first source electrode formed on the upper part of said first source and electrically connected to said first source;

an addressing thin-film transistor comprising a third gate formed on said insulation substrate, a gate insulation film formed on the upper part of the third gate including a portion fo the upper part of said insulation substrate, a second semiconductor channel formed on said gate insulation film, a second source and a second drain formed on a certain portion at each end of said second semiconductor channel, and a second source electrode formed on the upper part of said second source and electrically connected to said second source; and a connection electrode electrically connecting said second drain of said addressing thin-film transistor with said second gate of said control thin-film transistor.

5. The field emission display device as claimed in claim 4, wherein said field emitter array comprises a plurality of triode-type field emitters.

6. The field emission display device as claimed in claim 4, wherein the source of said control thin-film transistor is formed to be vertically overlapped with the gate, and the drain is formed not to be vertically overlapped with the gate.

7. The field emission display device as claimed in claim 4, wherein said control thin-film transistor and said addressing thin-film transistor comprises inverted stagger type amorphous silicon thin-film transistors.

8. The field emission display device as claimed in claim 4, wherein the semiconductor channels of said control thin-film transistor and said addressing thin-film transistor comprise a hydrogenated amorphous silicon thin-film.

9. The field emission display device as claimed in claim 4, wherein the gate insulation films of said control thin-film transistor and said addressing thin-film transistor comprise a silicon nitride ($SiN_x$) film.

10. The field emission display device as claimed in claim 4, wherein said insulation substrate comprises a glass substrate.

* * * * *